United States Patent [19]

Bollen

[11] Patent Number: 4,986,489

[45] Date of Patent: Jan. 22, 1991

[54] THREAD BRAKING MECHANISM WITH CATCHMENT DEVICE

[75] Inventor: Manfred Bollen, Oberuzwil, Switzerland

[73] Assignee: Benninger AG, Uzwil, Switzerland

[21] Appl. No.: 392,267

[22] Filed: Aug. 10, 1989

[30] Foreign Application Priority Data

Aug. 10, 1988 [CH] Switzerland ..... 3020/88

[51] Int. Cl.[5] ..... B65H 59/16; B65H 59/22

[52] U.S. Cl. ..... 242/151; 242/131

[58] Field of Search ..... 242/131, 131.1, 151; 28/190, 194

[56] References Cited

U.S. PATENT DOCUMENTS 2,688,789 9/1954 Duryee ..... 28/194 X
2,689,393 9/1954 Duryee ..... 28/194 X
4,535,956 8/1985 Wildi et al. ..... 242/151

FOREIGN PATENT DOCUMENTS 21296 3/1914 United Kingdom ..... 242/131

*Primary Examiner*—Werner H. Schroeder
*Assistant Examiner*—Bradley Kurtz DeSandro
*Attorney, Agent, or Firm*—Woodcock, Washburn, Kurtz, Mackiewicz & Norris

[57] ABSTRACT

A blocking device, preferably in the form of a baffle plate is provided behind the rollers of a thread tightener in a bobbin creel which can be pressed against one another, namely behind the roller pair in the direction of the through-passage. In case of a thread break, the baffle plate prevents the loose thread end from falling out of the roller tightener. Preferably, the baffle plate is latched onto a thread hoop and rotatably journalled, so that it can be swung from an operations position into a neutral position.

7 Claims, 4 Drawing Sheets

Fig.4
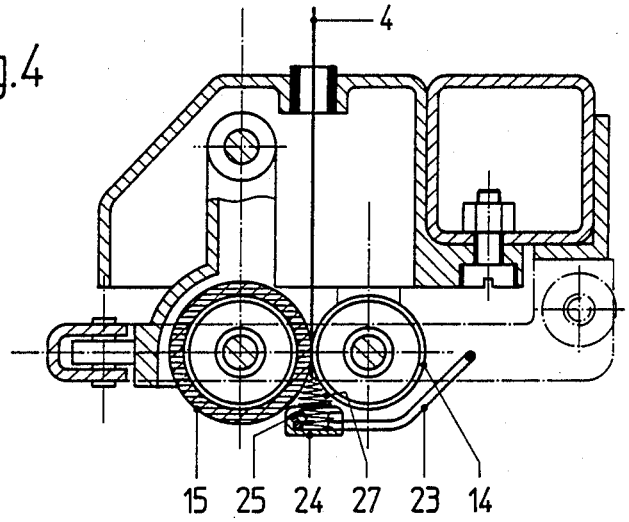
Fig.5
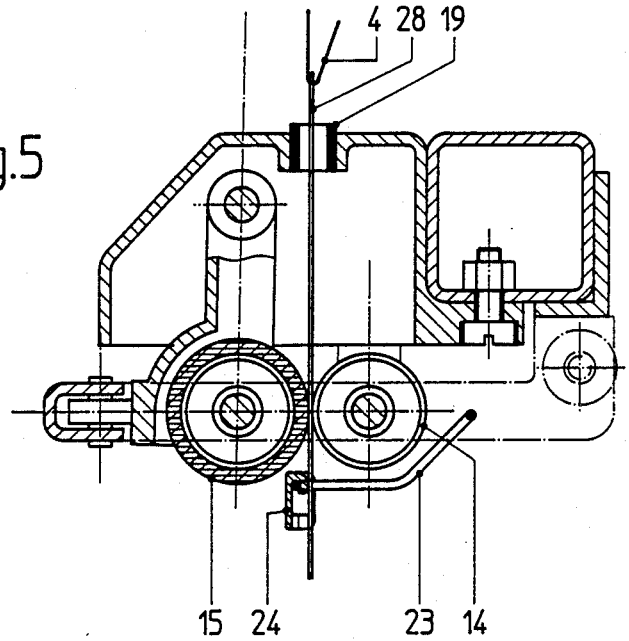
Fig.6a
Fig.6b
Fig.6c
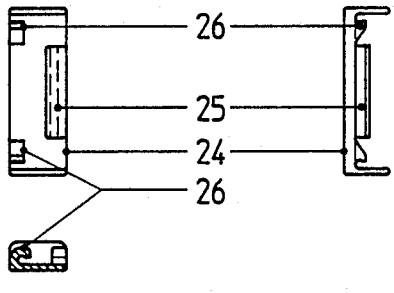

THREAD BRAKING MECHANISM WITH CATCHMENT DEVICE

The present invention relates to methods and apparatus for braking of threads, or thread-like products, particularly for warping machines of the type used in the textile industry.

BACKGROUND OF THE INVENTION

With a thread brake thread is squeezed between a fixed roller with a relatively hard surface and a moveable roller that can be moved horizontally and has a rubber elastic surface. Pressure of the movable roller against the fixed roller and the resultant deformation of the rubber elastic roller surface permits the thread tension to be adjusted to the desired value. Thereby, the roller with the hard surface generally also serves to deflect the thread from the bobbin creel in the direction of a lapping frame with a wrap angle of approx. 90°. Such a known thread brake is shown and described in U.S. Pat. No. 4,535,956 which is assigned to the assignee of the present invention.

With the known thread brakes, problems may occur particularly in the case of a thread breakage. However, the existing thread guards ascertain that the lapping process is immediately interrupted in case of a thread breakage whereby, in some cases, the pressure force between the rollers is simultaneously increased so that the thread brake stops the advancement of the thread practically simultaneously with the lapping machine. This makes it possible to largely prevent after-running or stretching of the still intact threads. However, at the particular thread brake where the thread breakage occurred, it is not possible to prevent a certain length of thread from passing between the rollers before the thread is stopped, since there is a delay of several fractions of a second between the detection of the thread break at the thread guard and the triggering of the machine stoppage. Due to inertia, the rollers continue to turn during this interval, so that a thread length of up to 10 meters or more is pulled off the bobbin and transported through the thread brake.

Without tractive force, this thread, which is no longer under control, then leaves the thread brake on a straight line and falls onto the thread field below, where it may cause entanglements and additional thread breaks. Thus, the restart of the installation will require a labor-intensive and time-consuming unraveling of the threads which may cause relatively long down times.

Consequently, it is the purpose of the invention to create a method and apparatus for the breaking of thread, with the aid of which free advancement of a torn thread will be prevented in case of a thread break.

SUMMARY OF THE INVENTION

The present invention is directed to an improved thread brake that includes a catchment device. After a thread break, the catchment device retains the advancing thread in a simple and effective manner preventing it from entanglement with adjacent threads. Thereby, the deflection angle of the thread prior to the break, if any, is of no significance. In the absence of tensile stress, the broken thread will leave the contact area of the rollers approximately in a plane extending through the contact area of the rollers. The catchment device must be located in this plane in order to have optimal efficiency.

Preferably, the catchment device is designed as a baffle plate which covers the contact area of the rollers and thus runs approximately parallel with a connection plane between the two roller axes. As a rule, the baffle plate is completely sufficient to retain the torn thread, since a ball of thread is immediately formed, which is pinched between the baffle plate and the roller surfaces. Naturally, the catchment device could also be designed in the form of a basket-like or box-like container.

The attachment of the baffle plate is achieved in a particularly advantageous manner thereby that a thread hoop is located behind the roller pair in the direction of passage, and that the baffle plate is attached to the thread hoop. The thread hoop prevents the thread from falling out of the contact area of the rollers when the roller pair is opened and exerts no pressure. Such a hoop is required particularly when the roller axes are arranged vertically. The baffle plate can be attached to the thread hoop in a particularly simple manner without need for additional holding devices. This is important, particularly with respect to simple cleaning of the device.

In order to facilitate operations at the thread brake, the baffle plate is advantageously rotatably journalled so that it can be swung from the operational position into a neutral position, in which there is free access to the contact area of the rollers. In this manner, the thread ball accumulated behind the baffle plate can be removed in a particularly simple manner. The insertion of a new thread into the thread brake is also facilitated thereby.

The rotatable journalling can be achieved thereby that on one side, the baffle plate has a catch joint, by means of which it can be latched in an articulated manner onto the thread hoop, and that on an opposite side, there is at least one catch lock, by means of which the baffle plate can be locked to the thread hoop. As can be seen, the baffle plate can also easily be completely removed, which may be desirable, e.g. under certain operating conditions.

The arrangement of the baffle plate in the manner described is logical, particularly in cases when the thread is introduced into the roller pair in that plane which extends through the contact area of the rollers when these are pressed together. For this purpose, a guide lug may be arranged on the device to ascertain that the thread is always introduced into the roller pair at the same angle.

If the baffle plate has at least one threading opening from which a slot leads to a limiting edge of the baffle plate, insertion of the thread is also possible when the baffle plate is closed. A threader hook which is used to pick up the thread can be brought through the threading opening brought through the threading opening to pick up the thread. The thread can be brought out of the threading opening through the slot.

BRIEF DESCRIPTION OF THE DRAWING

The present invention will be more fully described with reference to the accompanying drawing in which:

FIG. 4 is the device according to FIG. 3, showing a thread break;

FIG. 5 is the device according to FIG. 3 showing the reinsertion of a thread;

FIGS. 6a–6c are a top view, a side view, and a cross sectional view, respectively of a baffle plate;

DETAILED DESCRIPTION OF THE PREFERRED EMBODIMENT

Figure 1:
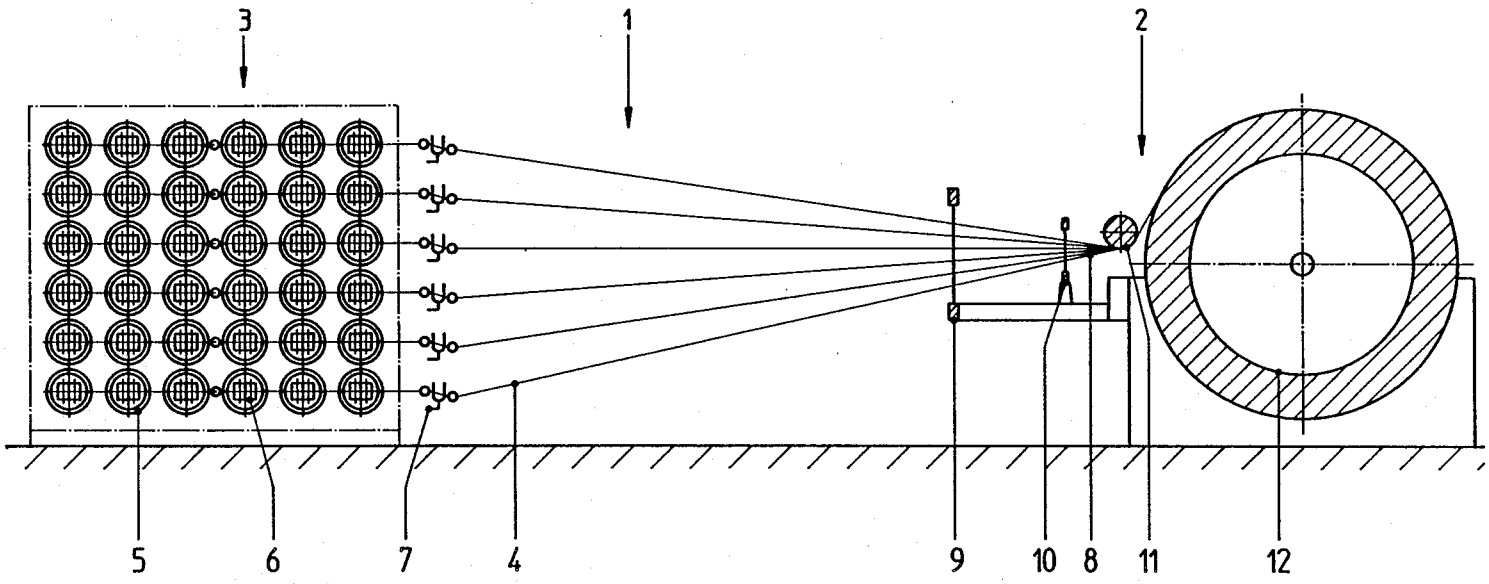
FIG. 1 is a side view of a lapping installation with several thread brakes.

FIG. 1 shows a lapping installation 1, e.g. a warping installation, consisting of a warping machine 2 and a bobbin creel 3, whereby several threads 4 are pulled off the bobbins 5 on the bobbin creel 3. In sequence, the threads each pass a bobbin tightener 6 to create a constant thread tension, and a thread guard 7 for control of thread presence. Subsequently the threads arrive at the warping machine 2 as web 8. Inside the warping machine, the web 8 passes a cross-reed 9, in which the relative positions of the individual threads 4 in the web 8 are determined, and subsequently the warping reed 10, in which the group of threads, 8 obtains its width. Subsequently, via a deflection roller 11, the web 8 is wound onto the warping drum 12 of the warping machine.

Figure 2:
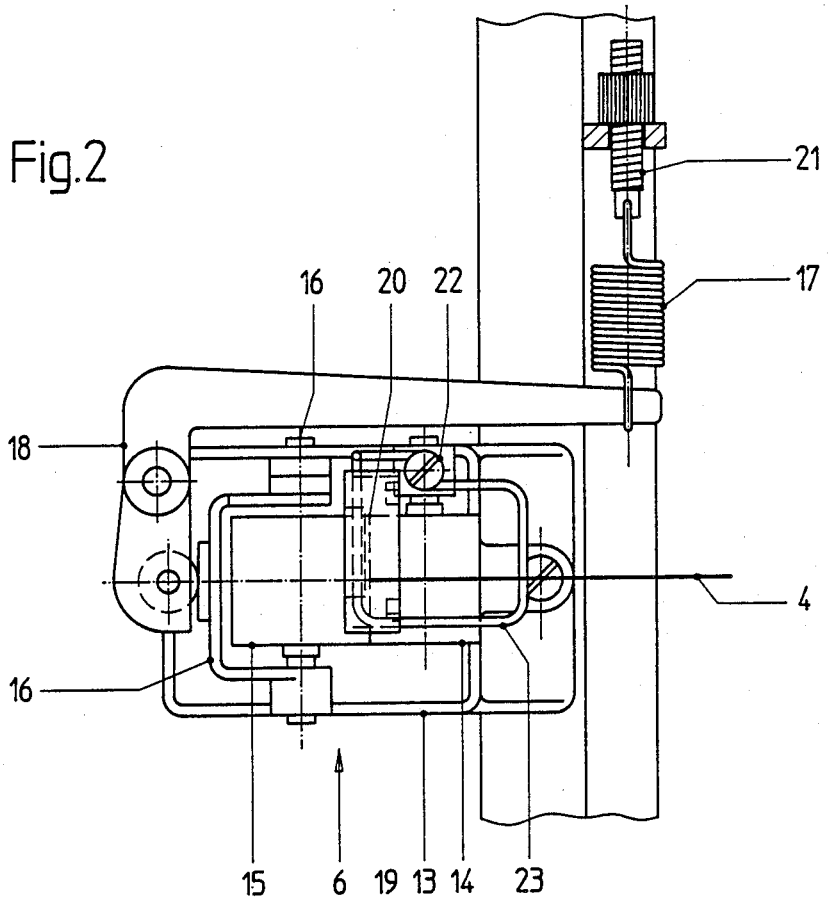
FIG. 2 is a side view of a device according to the present invention.
Figure 3:
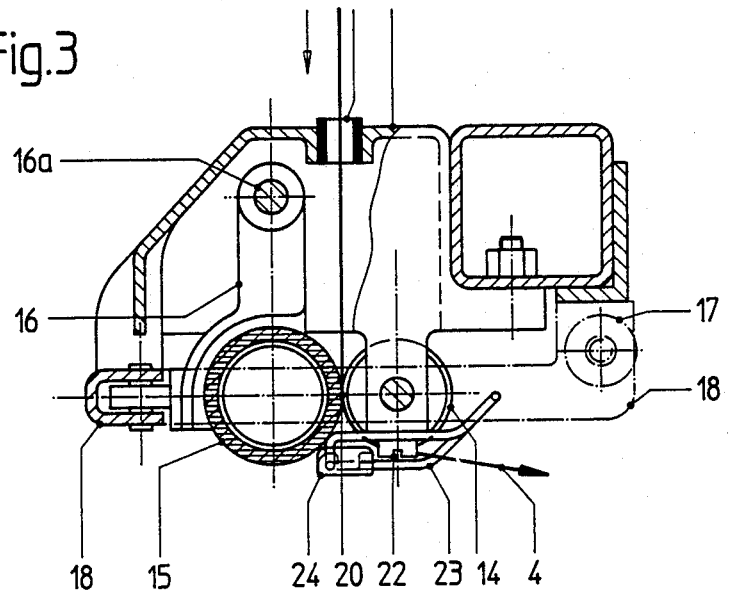
FIG. 3 is a partial cross-sectional top view of the device according to FIG. 2 with a thread running normally.

The basic structure of a bobbin tightener 6, is shown in FIGS. 2 and 3. The basic structure of a bobbin tightener 6 is known per se and shown in U.S. Pat. No. 4,535,956 mentioned above, however the improvement of the present invention is shown in FIGS. 2 and 3. A stationary roller 14, freely rotatable and with a relatively hard surface, is installed at the 10 housing 13. A lever arm 16, rotatable around an axis 16a, is linked to the housing. The movable roller 15, also freely rotatable, and provided with a rubber elastic cover, is attached at the end of the lever arm. The rollers 14 and 15 are rotatable about parallel axes and, together, these rollers define a thread brake as described above.

Due to the effect of a draw spring 17, an angled lever 18 is pressed with greater or lesser pressure against the free end of the lever arm 16, so that the movable roller 15 is, in turn, pressed against the stationary roller 14. In order to obtain optimum power transfer, a roller is arranged at the angled lever 18. By pressing the roller 15 with rubber-elastic cover against the roller 14 with relatively hard surface, a piling action occurs during rotation, the magnitude of which action can be determined by adjusting the draw spring 17 by means of the locking screw 21.

The thread 4 from the bobbin 5 passes through the lug 19 into the housing 13 and runs between the rollers 14 and 15 in the contact area or zone 20. Subsequently the thread 4 is deflected by the stationary roller 14 and arrives via guide lugs, not shown, to the thread guard 7 (FIG. 1). A thread hoop 23 is attached to the housing 13 by means of a screw 22 behind the roller pair 14, 15, in the direction of through passage. As already stated, the purpose of this thread hoop is to prevent the thread 4 from falling down when the movable roller 15 is swung back such that it is no longer in engagement with the roller 14. In accordance with the present invention, a catchment device, or baffle plate 24 is attached to the thread hoop 23 downstream of the roller pair 14 and 15 in the direction of thread travel. The catchment device or baffle plate lies in a plane generally parallel to the axes of the roller pair 14, 15 and is provided for restraining the further travel of the thread 4 past the catchment device or baffle plate 24 in the event of thread breakage. The configuration of which plate can be seen from FIGS. 6a through 6c.

The baffle plate 24 is preferably manufactured from a synthetic material and has an approximately rectangular configuration corresponding to the height of the rollers 14, 15. On one long side, there is a catch joint 25, by means of which the baffle plate can be latched to the vertical side of the thread hoop 23 in an articulated manner. As can be seen particularly from a comparison between FIG. 3 and FIG. 5, the baffle plate can thereby be swung out of its operational position by 90 degrees, or more, so that there is free access to the contact area between the rollers 14, 15.

However, the baffle plate 24 is also provided with at least one catch lock 26, by means of which it can be locked to the thread hoop 23 in the operational position. Thus, the baffle plate 24 can be swung around the thread hoop 23 by disengaging or engaging the catch lock 26 at the thread hoop 23, or it can be completely removed from the thread hoop 23 by also disengaging the catch joint 25. At its upper and lower narrow sides, the baffle plate 24 is angled towards the contact area 20, so that a thread ball will be securely retained.

FIG. 3 shows the baffle plate 24 in its normal operational position, in which the thread 4 is pulled at an angle and through the slot between roller 14 and baffle plate 24. If a thread 4 should break, a specific length of thread is pulled out within the above mentioned delay time until the installation has been deactivated.

Due to the lack of traction force the pulled-out thread will no longer be deflected at the roller 14 (as shown in FIG. 3) but will, instead be thrown against the baffle plate 24, where a thread ball 27 is formed. This condition is illustrated in FIG. 4. The accumulating thread ball 27 will also provide additional braking to that provided by the roller pair 14, 15.

In the event of a thread break the ball 27 can be removed in a very simple manner because the baffle plate 24 is swung out as represented in FIG. 5. Normally, new threading through the rollers 14, 15 is not required, since the torn threads can be tied together. However, in certain cases, e.g. if a thread breaks in front of the bobbin tightener 6, the thread must be inserted into the bobbin tightener, which is done by means of a hook 28. FIG. 5 shows that when the baffle plate 24 is swung out, there is free access to the contact area or zone 20 between the rollers, so that the hook 28 can be guided through the lug 19 for engagement with the thread.

After repairing a thread break or after reinsertion of a thread 4, the baffle plate 24 is swung back and latched into the thread loop 23 at the catch locks 26.

Figure 7:
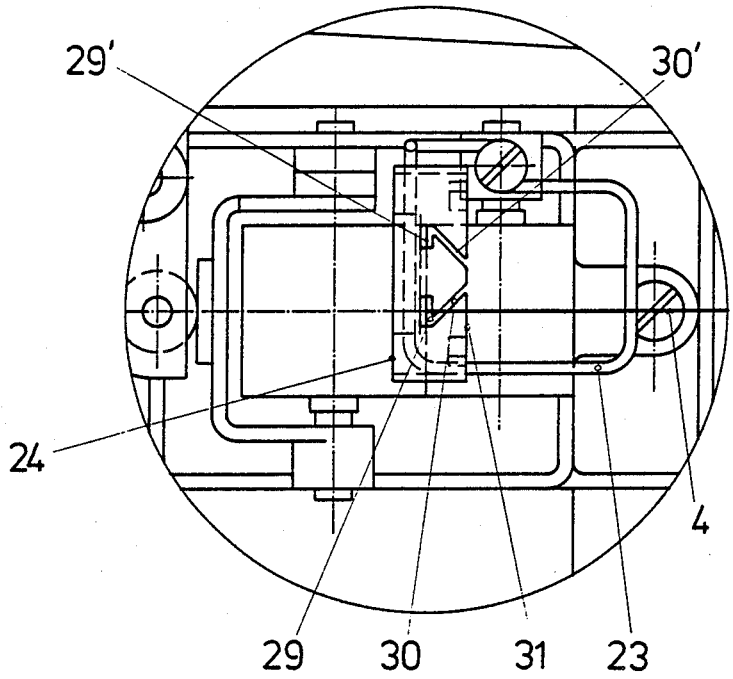
FIG. 7 is a side view of an alternate embodiment of a baffle plate, in enlarged representation.
Figure 8:
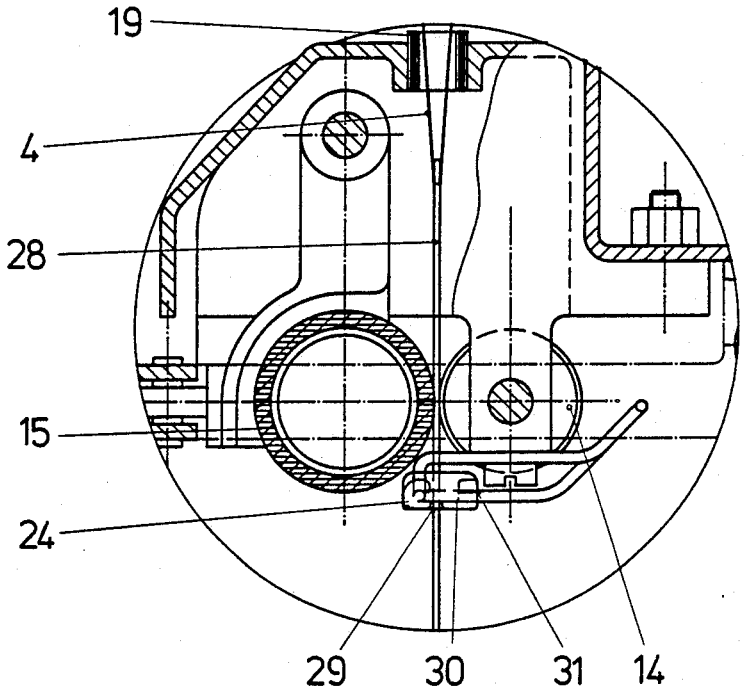
FIG. 8 is a top view of the baffle plate according to FIG. 7, when a thread is reinserted.

FIGS. 7 and 8 show another embodiment, in which the baffle plate 24 need not be opened for insertion of the thread. For this purpose, the baffle plate 24 is provided with openings 29, 29', both of which are connected with the limiting edge 31 of the baffle plate 24 by means of slots 30, 30' respectively. That limiting edge of the plate is oriented towards the deflection roller 14, namely through a slot 30, 30'. The openings 29,29' are located in a plane perpendicular to the path of the thread 4 which is guided towards the rollers 14, 15. The slots 30 are symmetrically sloped towards one another so that the baffle plate 24 can be snapped onto the thread hoop 23 from two sides.

For insertion of the thread 4 through the lug 19 and between the rollers 14, 15, the hook 28 is brought through one of the openings 29 or 29'. The thread is first pulled through the opening 29 or 29' and then exits through the corresponding slot 30 or 30'. In actuality, the baffle plate need only be swung out in case of a thread break when a thread ball must be removed. In no way do the openings 29, 29' impair the function of the baffle plate 24.

I claim:

1. A device for braking threads or thread-like products, particularly for warping machines, comprising:

a pair of rotatably journalled rollers which can be pressed against one another to form a contact zone therebetween for receiving a moving thread or thread-like product; and a catchment device located downstream of the roller pair in the direction of thread travel, said catchment device being in a plane generally parallel to the axes of the roller pair for restraining the further travel of the thread past the catchment device and for retaining the thread without tensile stress in the event of a thread break.

2. A device according to claim 1 wherein the catchment device comprises:

a baffle plate arranged approximately in parallel with a plane running through the axes of both rollers.

3. A device according to claim 2 further comprising a thread hoop located downstream the roller pair in the direction of thread travel, the baffle plate being attached to the thread hoop.

4. A device according to claims 2 or 3 wherein the baffle plate is rotatably mounted and moveable from an operational position to a neutral position in order to provide access to the contact zone.

5. A device according to claim 3 wherein the baffle plate further comprises:

a catch joint for attaching said plate in an articulated manner to the thread hoop; and at least one catch lock for locking said baffle plate to aid thread hoop.

6. A device according to claim 2 wherein the baffle plate is made of synthetic materials.

7. A device according to claim 2 wherein the baffle plate has at least one pass through opening from which a slot leads to a limiting edge of a baffle wall.

* * * * *